US006830086B2

(12) United States Patent
Smith et al.

(10) Patent No.: US 6,830,086 B2
(45) Date of Patent: Dec. 14, 2004

(54) FOLDABLE CLIP FOR PUMP HANDLE

(76) Inventors: S. Douglas Smith, 6991 Shady Oaks Dr., Trussville, AL (US) 35173; Kenneth L. Preuitt, Jr., 104 Summit Ridge Ct., Nashville, TN (US) 37215

( * ) Notice: Subject to any disclaimer, the term of this patent is extended or adjusted under 35 U.S.C. 154(b) by 0 days.

(21) Appl. No.: 10/095,370

(22) Filed: Mar. 11, 2002

(65) Prior Publication Data

US 2003/0168121 A1 Sep. 11, 2003

(51) Int. Cl.[7] ..... B65B 1/04; B65B 3/00; B67C 3/00

(52) U.S. Cl. ..... 141/392; 251/90

(58) Field of Search ..... 141/392; 251/90; 248/74.1, 226.11, 228.4, 206.5; 24/19, 455

(56) References Cited

U.S. PATENT DOCUMENTS

| | | | | | |
|---|---|---|---|---|---|
| 4,210,181 | A | | 7/1980 | Clevenger | |
| 4,216,807 | A | | 8/1980 | Diamond | |
| 4,245,682 | A | | 1/1981 | Agnew, Sr. | |
| 4,287,736 | A | | 9/1981 | Hadgis | |
| 4,337,917 | A | | 7/1982 | Tesack et al. | |
| 4,524,992 | A | * | 6/1985 | Linn | 281/45 |
| D282,048 | S | | 1/1986 | Scanlon | |
| D288,170 | S | | 2/1987 | Foster | |
| 4,683,923 | A | | 8/1987 | Harris | |
| 4,690,182 | A | | 9/1987 | Knaus | |
| 4,846,447 | A | | 7/1989 | Hanna | |
| 4,858,861 | A | * | 8/1989 | Wilkinson, III | 248/74.1 |
| 5,024,405 | A | * | 6/1991 | McGuire | 248/73 |
| 5,077,850 | A | | 1/1992 | Brubaker | |
| 5,118,074 | A | | 6/1992 | Weissman | |
| 5,517,732 | A | | 5/1996 | Crear | |
| 5,535,970 | A | * | 7/1996 | Gobbi | 248/74.2 |
| 5,577,697 | A | * | 11/1996 | Accordino | 248/206.5 |
| 5,595,367 | A | | 1/1997 | Sternes et al. | |
| 5,752,554 | A | | 5/1998 | Campbell | |
| 6,048,062 | A | * | 4/2000 | Chow | 351/63 |

* cited by examiner

*Primary Examiner*—Timothy L. Maust
(74) *Attorney, Agent, or Firm*—Bradley, Arant, Rose & White

(57) ABSTRACT

A clip that holds the dispensing lever of a fluid dispensing pump in an open position, thereby controlling the flow of liquid from the pump without the necessity of the user manually applying pressure to the dispensing lever. One use of the clip is on the gasoline pumps at self service gasoline pumps. The clip is of a generally U-shape and comprises a shank, two upwardly turning legs at each end of the shank and a first and second arm pivotally attached to the first and second legs, respectively. The clip is capable of alternating between a folded state and an extended state. The clip is constructed so that the first and second arms pivot inwardly towards the shanks reducing the clip to the compact form when not in use.

17 Claims, 2 Drawing Sheets

FIG. 1
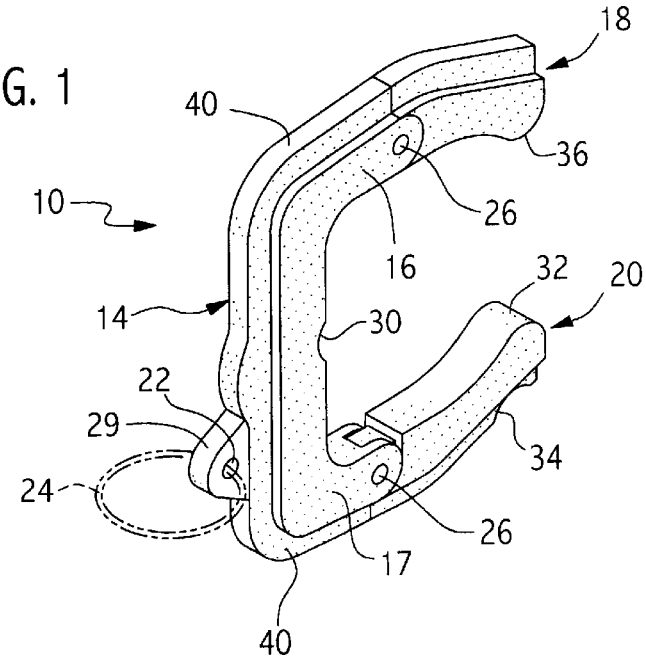
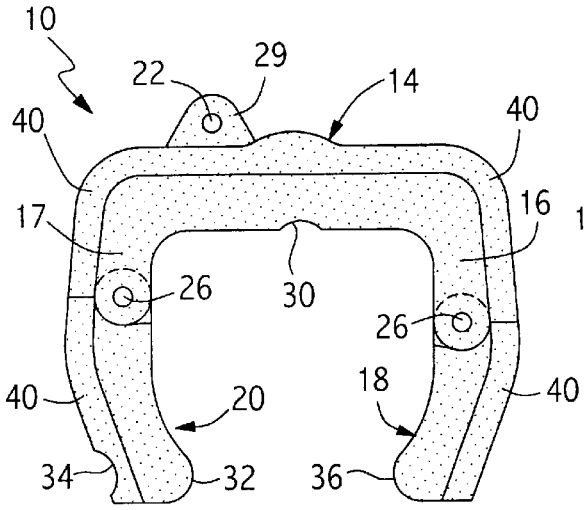
FIG. 2
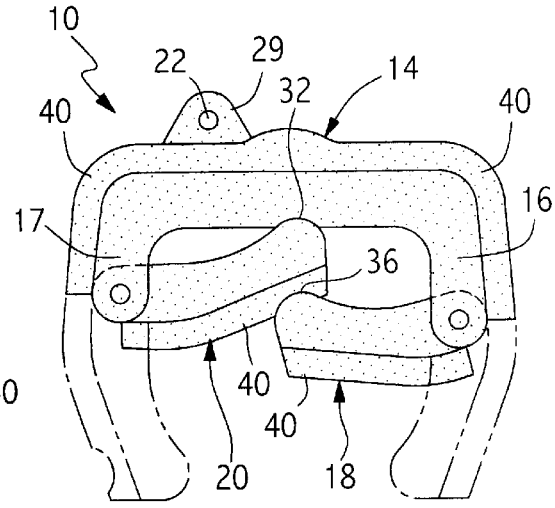
FIG. 3

FOLDABLE CLIP FOR PUMP HANDLE

FIELD OF INVENTION

The present disclosure relates generally to a device for use with fluid dispensing pumps, such as gasoline pumps. More specifically, the invention relates to a device that automates the process of dispensing liquids, such as gasoline, from the pumps by locking the dispensing lever of a pump handle in an open position so that liquid will flow from the pump without the user being required to maintain pressure on the dispensing lever of the pump handle.

BACKGROUND

A fluid dispensing pump, such as a gasoline pump, operates by the user applying upward pressure to, or squeezing, the dispensing lever of the pump handle. Through this squeezing action, the dispensing lever is pushed towards the top of the pump handle. As the dispensing lever is pushed towards the top of the pump handle, the valve controlling the flow from the pump is moved from the "off" position to the "on" position and liquid flows out of the pump, through the pump handle nozzle, and into the user's vehicle. When the dispensing lever is so engaged, the dispensing lever can be said to be in the open position. In the description that follows, reference may be made to gasoline pumps dispensing gasoline. However, the disclosure should not be limited to use on gasoline pump handles as the disclosure is applicable to any pump that operates on similar principles.

Many gasoline pump handles are equipped with automated devices, such as latches, that lock the dispensing lever in the open position. Generally, these automated devices are located on the bottom portion of the gasoline pump handle and operate by applying upward force on the dispensing handle, thereby locking the dispensing handle in the open position. However, many pump handles are not equipped with these devices, or the owners have removed or disabled these devices.

When the pumps handles are not equipped with a device to lock the dispensing lever in the open position, the user is presented with the inconvenience of standing by the pump and manually maintaining the dispensing lever in the open position. Apart from the inconvenience, the user is prevented from attending to other chores normally tended to when purchasing gasoline, such as washing the windows, checking the oil level or checking air pressure in the tires. By being able to accomplish these tasks at the same time that the gas is being pumped into the vehicle, the user's time spent at the gasoline station is greatly decreased. In addition, individuals with physical disabilities effecting their strength or dexterity may be incapable of applying the needed pressure to place and/or maintain the dispensing lever in the open position, forcing the individual to use the more expensive full-service option.

Several attempts have been made to provide devices that automate the process of dispensing gasoline for use with gasoline pumps handles that lack the automated devices. These devices can be divided into two classes. The first class of devices operate by fitting between the bottom portion of the gasoline pump handle and the dispensing lever. Devices in this class operate by applying an upward force on the dispensing lever, thereby locking the dispensing lever in the open position. These include U.S. Pat. No. 4,210,181 to Clevenger, U.S. Pat. No. 4,216,807 to Diamond, U.S. Pat. No. 4,334,560 to Lockwood, and U.S. Pat. No. 4,337,917 to Tesack. These devices suffer from the drawback that they cannot be easily or quickly removed if the user is suddenly required to stop the flow of gasoline. In addition, the devices generally require a substantial amount of manual dexterity to use properly.

The second class of devices operate by simultaneously engaging the top portion of the pump handle and the dispensing lever, locking the dispensing handle in the open position. These devices mimic the natural action of the users hand when squeezing the dispensing lever. These include U.S. Pat. No. 4,287,736 to Hadgis, U.S. Pat. No. 4,690,182 to Knauss, U.S. Pat. No. 4,683,923 to Harris, U.S. Pat. No. 4,846,477 to Hanna, U.S. Pat. No. 5,118,074 to Weissman, U.S. Pat. No. 5,077,850 to Brubaker and U.S. Pat. No. 5,517,732 to Crear. Several of these references disclose devices that can be modified to receive a key ring, allowing the user to attach keys to the device, contemplating that the user will carry the device on their person, making access to the devices more convenient. However, the devices disclosed by these references are bulky and do not lend themselves to storage on the person of the user. Additionally, many of the devices, such as Hadgis (the '736 patent) for example, contain hooked appendages, serrated edged, or other structures that could snag the users clothing, or become entangled with other articles when stored in the users pocket or purse.

None of these difficulties are inherent in the present disclosure. The present disclosure provides for a clip that is capable of locking the dispensing lever of a pump in an open position, and which is capable of being folded into a compact form when not in use. None of the references cited above teach or suggest the use of a clip that can be folded into a compact form. Because the clip can be folded, it is compact enough to be stored conveniently on the person of the user, facilitating its easy access for use. Furthermore, there are no rough edges or other appendages to snag clothing and to become entangled with other articles, making access to and use of the present invention more convenient.

SUMMARY

The present disclosure comprises a generally U-shaped clip that is designed to engage the dispensing lever of a fluid dispensing pump, such as a gasoline pump, and lock the dispensing lever of the pump handle in the open position. In one embodiment, the clip comprises a shank, with a first and a second upwardly turning leg at each end thereof, and a first and a second arm pivotally attached to the first and the second legs, respectively.

The clip is constructed so that the first and second arms are pivotally attached to the first and second legs, respectively. By virtue of the pivotal attachment, the first and second arms fold inwardly onto the shank of the clip to significantly reduce the size of the clip. This compact size allows the user to keep the clip in their pocket or purse for ready access when needed. When folded, the second arm rest on the shank and the first arm rest on top of the second arm. The arms can be pivotally attached by any means that allows the arms of the clip to fold inwardly towards the shank of the clip, but a preferred means is to use rivets. The length of the first and second legs is such that when second arm is folded inwardly towards the shank, the first arm will rest on top of the second arm when the first arm is folded inwardly towards the shank.

The clip operates by simultaneously engaging the top of the pump handle with the first arm and the dispensing lever with the second arm. The space between the first and second arms is determined by the length of the shank, and is such that while the first and second arms are engaging both the top of the pump handle and the dispensing lever, the dispensing lever is locked in an open position. The length of the shank can be varied so that the clip can be used with pump handles of various dimensions.

The clip can be constructed of any material, but a preferred material is high-strength plastic. Additionally, the clip may be constructed with a rib design to further impart strength to the clip without increasing the overall thickness of the clip.

In a preferred embodiment, the clip is manufactured with a hole through the thickness of the shank. A ring or similar device can be Attached to the clip by being passed through the hole, allowing the user to attach keys or other articles to the clip. A feature of the clip so constructed is that the user can quickly remove the clip and restore the dispensing handle to the closed position by pulling on the ring or attached articles and stop the flow of fuel from the nozzle when desired.

Therefore, it is an object of the disclosure to provide a clip for automating the process of dispensing liquids, such as gasoline, by locking the dispensing lever of a pump handle a in an open position so that liquid will flow from the pump without the user being required to maintain pressure on the dispensing lever of the pump handle.

Another object of the disclosure to provide such a clip that is capable of being folded into a compact form when the clip is not in use.

It is a further object of the disclosure to provide such a clip constructed out of plastic, or other lightweight material.

It is a further object of the disclosure to provide such a clip that is capable of receiving a ring or similar device, allowing the user to attach keys or other articles to the clip.

BRIEF DESCRIPTION OF THE DRAWINGS

FIG. 1 is a side view of one embodiment of the clip in its non-folded form.

FIG. 2 is a front view of one embodiment of the clip in its non-folded form.

FIG. 3 is a front view of one embodiment of the clip in its folded form.

DESCRIPTION

Figure 4:
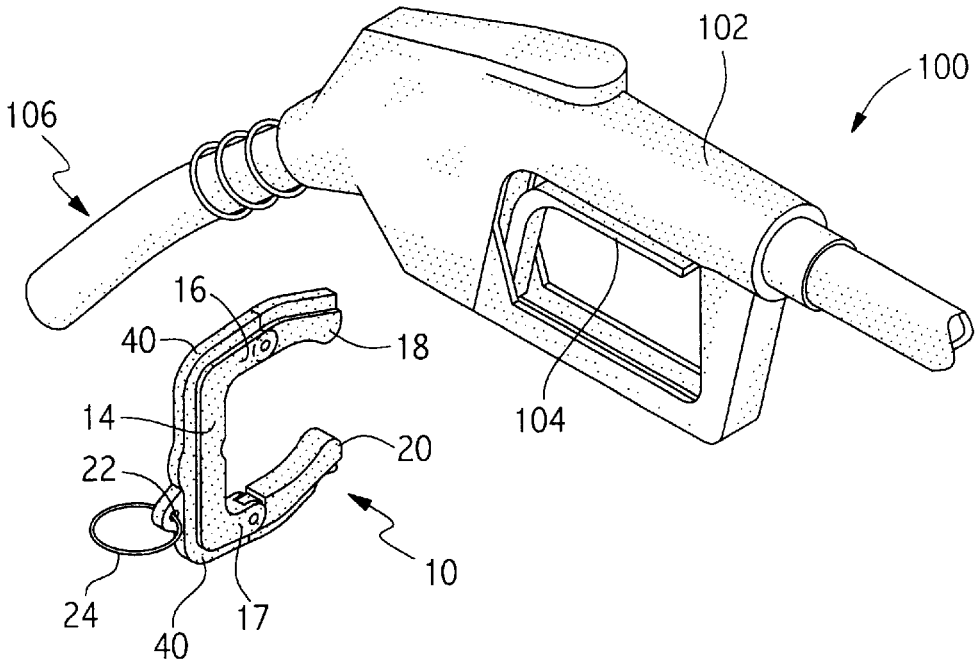
FIG. 4 is a perspective view showing one embodiment of the clip being applied to a standard gasoline pump handle.

The invention can be best understood by reference to the accompanying drawings presented in FIGS. 1 through 5. FIGS. 1 and 2 show a perspective side and front view, respectively, of a one embodiment of the clip of the present disclosure. The clip 10 is of generally a U-shape and is composed of a shank 14, a first 16 and second 17 upwardly turning leg at each end of shank 14, a first arm 18 and second arm 20 pivotally attached to the first 16 and second 17 upwardly turning legs, respectively. In the embodiment illustrated in FIGS. 1–5, one of the legs, in this case first leg 16, is of greater length than the other leg, in this case second leg 17. This is to facilitate folding of the clamp into a compact form as discussed below. However, in alternate embodiments, the length of each leg can be the same or substantially the same, and still be capable of being folded into a compact form. A means for receiving a key ring 24 or similar device may also be incorporated into the clip. As illustrated best in FIGS. 1–3, the means may be a hole 22 placed along the shank 14. The hole 22 may be through the thickness of the shank 14 itself, or it may be through a portion 29 appending from the shank 14 (as illustrated in FIGS. 1–3). The hole 22 may be placed anywhere on the shank 14, but a preferred position is on the shank 14 adjacent to one of the legs, illustrated in this case adjacent to the second leg 17.

The first arm 18 and the second arm 20 are pivotally attached to the first leg 16 and second leg 17, respectively. The means for the pivotal attachment can be any one that allows the first arm 18 and second arm 20 fold inwardly toward the shank 14 (as illustrated in FIG. 3), such as rivets, pins, ball and joint connections, dowels or small screws (the screws either being secured by nuts or self-securing). However, a preferred method for pivotal attachment is through the use of a rivet 26. It is preferred that both the first arm 18 and the second arm 20 fold inwardly towards the shank 14 as illustrated in FIG. 3.

The clip 10 contains a means for maintaining the shank 14, first leg 16, second leg 17, first arm 18 and second arm 20 in a generally U-shaped configuration during use of the clip 10. The means can be through a locking mechanism, springs, or angularities created by the pivotal attachment of the first 18 and second 20 arms to the first 16 and second 17 legs. However, a preferred means is through the use of angularities created by the pivotal attachment. As can be seen in FIGS. 1–3, the first arm 18 and second arm 20 are prevented from free rotation about their attachment point (in this case rivet 26) by the angle created by their attachment to the first leg 16 and second leg 17. The angle is such that the first arm 18 and second arm 20 will not rotate past a point where they are generally parallel to the first leg 16 and second leg 17. In this manner, the first arm 18 and second arm 20 will be able to keep the dispensing lever of a pump handle in the open position. In a preferred embodiment, the clip 10 has the following dimensions. The length of the first arm 18 is approximately 32 centimeters and the length of the second arm 20 is approximately 35 centimeters. The width of the clip from the midpoint of the first leg 16 to the midpoint of the second leg 17 is approximately 55 centimeters and the width of the clip from the outer edge of the first leg 16 to the outer edge of the second leg 17 is approximately 73 centimeters. The attaching means (illustrated as portion 29) is placed approximately 46 centimeters from the outer edge of the first leg 16. These dimensions are suited for a clip designed for use with a standard gasoline pump handle and may be varied to fit other types of pump handles, with the selection of such dimensions being within the skill in the art.

FIG. 3 shows a perspective view of one embodiment of the clip 10 of the present disclosure in its folded form. As is illustrated by this figure, by virtue of their pivotal attachment to the first leg 16 and second leg 17, first arm 18 and second arm 20 can pivot inwardly towards the shank 14. In its folded configuration, the second arm 20 lies on top of and in the same plane as the shank 14. In its folded configuration, the first arm 18 lies on top of and in the same plane as the second arm 20. The clip 10 may contain certain depressions and protrusions to facilitate the folding of the clip 10. As illustrated best in FIGS. 1–3, the interior surface of shank 14 has a depression 30 to receive spine 32 on the second arm 20. Second arm 20 also has a depression 34 to receive a spine 36 on first arm 18. As used herein, the term spine should be interpreted encompassing any projection that is complementary to a depression described above. The placement and number of these depressions and spines is variable and alternate configurations are possible, with the configuration described in FIGS. 1–3 being illustrative only. The length of the first leg 16 and second leg 17 is selected such that when the first arm 18 pivots inwardly, it will lie against the second arm 20 when the second arm 20 is in its fully folded configuration, and the second arm 20 will lie against the shank 14.

The clip 10 can be constructed out of any material, including but not limited to aluminum, plastic, or even reinforced paper cardboard, but the preferred material is high-strength plastic. Several methods are known in the plastics manufacturing art to produce the clip 10, but a preferred method is injection molding. Through the use of this high-strength plastic the clip 10 can be manufactured so that it is durable, lightweight and possesses sufficient rigidity and strength to operate as intended.

As illustrated best in FIG. 1, the clip 10 may comprise a rib structure 40 to impart increased strength to the clip 10. It is desired to manufacture the clip 10 so its components are as thin as possible, while still retaining the strength and rigidity to operate as intended. As stated above, in one embodiment, the clip 10 is manufactured from high-strength plastic. To impart extra strength to the clip 10, it may be manufactured so that the shank 14, the first leg 16, second leg 17, first arm 18 and second arm 20 incorporate the rib structure 40. This rib structure 40 is preferably a ridge of plastic running down roughly the middle of the component parts of the clip 10. The rib structure 40 increases the strength of the clip 10, allowing the thickness of the component parts to be reduced, while still retaining the necessary strength and rigidity to function as intended.

Figure 5:
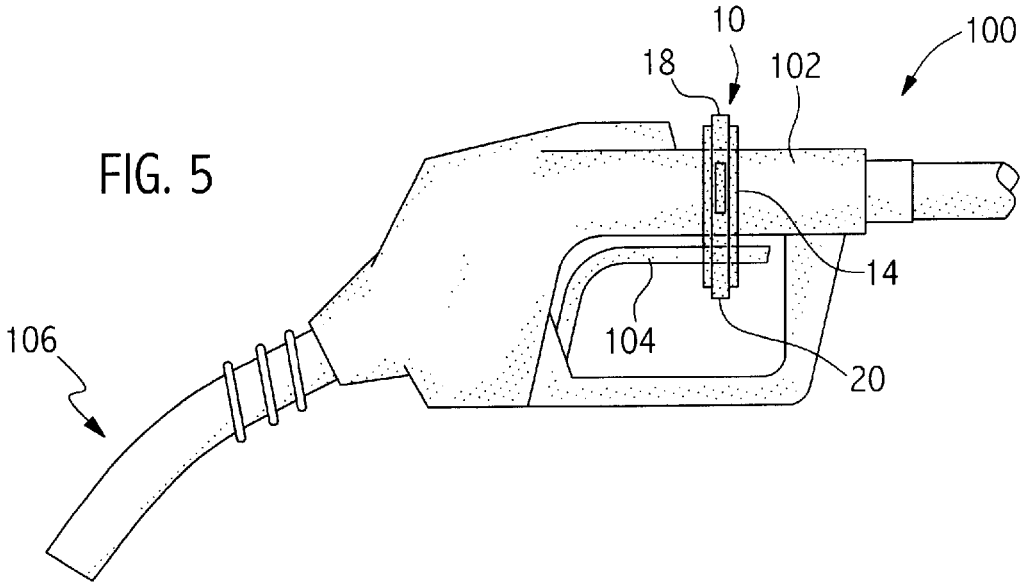
FIG. 5 is a perspective view showing one embodiment of the clip in use on a standard gasoline pump handle.

FIGS. 4 and 5 show clip 10 of the present invention in use on a standard gasoline pump handle. The clip 10 engages the pump handle 100 by simultaneously engaging the top portion 102 of the pump handle 100 and the dispensing lever 104. As illustrated in FIGS. 4 and 5, the first arm 18 engages the top portion 102, while the second arm 20 engages the dispensing lever 104. Through this action, the dispensing lever 104 is locked in an open position allowing gasoline to flow from the pump through pump handle nozzle 106 into the users vehicle or other storage container. The length of shank 14 is constructed so that when the first arm 18 engages the top portion 102 and second arm 20 engages the dispensing lever 104 of the pump handle 100, the dispensing lever 104 is held in an open position (as is obvious, the orientation of the clip 10 on the pump handle 100 may be reversed). The user is able to apply the clip 10 to the pump handle 100 using one hand. Furthermore, ring 24 provides a quick and efficient method to quickly remove clip 10 in situations that require the immediate shut-off of fuel flowing into the vehicle. As discussed above, the length of the shank 14 can be varied so that the clip 10 can be used on a wide range of pump handles.

In an alternate embodiment, a magnet may be placed on either face of the shank 14 of the clip 10. The magnet will allow the use to place and store the clip 10 on a metal surface, such as the inside of a gas cap. Alternate locations to store the clip on the car are possible, it being preferred that these alternate locations are close to the gas tank for ease of use.

The previously described embodiments of the present disclosure have many advantages. Other devices that automated the process of dispensing fuel were either too bulky to be easily carried on the person of the user, making their use inconvenient, or contained serrated teeth, sharp edges or other appendages that could cause the devices to become entangled with other articles when carried by the user or cause damage to the clothing or purse of the user when the clip is removed for use. The clip of the present disclosure overcomes these limitations. The clip of the present disclosure is capable of not only automating the process of dispensing fuel into the user's vehicle, but is also capable of being quickly and easily folded into a compact form when not in use. This compact form allows the user to store the clip on their person when not in use. The clip, in its folded form, has no teeth, sharp edges or other appendages to become entangled with other articles when carried by the user, or to damage the clothing or purse of the user when the clip is removed for use. These advantages are merely illustrative and are not intended to be a comprehensive listing of all the advantages inherent in the present invention.

Although the present invention has been described in considerable detail with reference to certain preferred and alternate embodiments thereof, other variations are possible which would be obvious to one of ordinary skill in the art. Therefore, the scope of the appended claims should not be limited to the description of the preferred and alternate embodiments contained herein.

What is claimed is:

1. A clip of a generally U-shape adapted to place a pump handle in an open position capable of alternating between a folded state and an extended state comprising:

a shank;

a first and a second upwardly turning leg at each end of the shank;

a first arm pivotally attached to the first leg and a second arm pivotally attached to the second leg, at least one of the first and second legs resting against the shank when the clip is in the folded state; and a means for maintaining the shank, the legs and the arms in the generally U-shaped configuration when the clip is in the extended state.

2. The clip of claim 1 where the first arm and the second arm pivot inwardly towards the shank to form the folded state.

3. The clip of claim 2 where the first leg is longer than the second leg and the second arm rests against the shank and the first arm rest against the second arm when the clip is in the folded state.

4. The clip of 3 where the shank has a first depression for receiving a spine on the second arm and the second arm has a second depression for receiving a spine on the first arm.

5. The clip of claim 2 further comprising a means for attaching a key ring or other device to the clip.

6. The clip of claim 5 where the means for attaching is an opening in the shank or an opening in a portion attached to the shank.

7. The clip of claim 6 where the means for attaching is located on the shank adjacent to either the first leg or the second leg.

8. The clip of claim 2 further comprising a magnet attached to the clip for securing the clip to a metal object.

9. The clip of claim 8 where the magnet is located on the shank.

10. The clip of claim 2 where one of the first or second legs is longer than the other of the first of second legs to facilitate forming the folded state.

11. The clip of claim 10 where the shank has a first depression to receive a spine on the arm attached to a shorter leg and the shorter leg has a second depression to receive a spine on the arm attached to a longer leg.

12. The clip of claim 2 where the means for maintaining the shank, the legs and the arms in the generally U-shaped configuration when the clip is in the extended state is the angularities created in the pivotal attachment of the first arm to the first leg and the pivotal attachment of the second arm to the second leg.

13. The clip of claim 1 further comprising a rib structure incorporated into the shank, the first and second legs and the first and second arms.

14. The clip of claim 4 further comprising a rib structure incorporated into the shank, the first and second legs and the first and second arms.

15. The clip of claim 7 further comprising a rib structure incorporated into the shank, the first and second legs and the first and second arms.

16. The clip of claim 9 further comprising a rib structure incorporated into the shank, the first and second legs and the first and second arms.

17. The clip of claim 11 further comprising a rib structure incorporated into the shank, the first and second legs and the first and second arms.

* * * * *